US012188131B2

(12) United States Patent
Yarino et al.

(10) Patent No.: US 12,188,131 B2
(45) Date of Patent: Jan. 7, 2025

(54) FASTENER MEMBER

(71) Applicant: YKK Corporation, Tokyo (JP)

(72) Inventors: Kentaro Yarino, Kurobe (JP); Itaru Hasegawa, Kurobe (JP)

(73) Assignee: YKK Corporation, Tokyo (JP)

( * ) Notice: Subject to any disclaimer, the term of this patent is extended or adjusted under 35 U.S.C. 154(b) by 589 days.

(21) Appl. No.: 17/271,267

(22) PCT Filed: Sep. 6, 2018

(86) PCT No.: PCT/JP2018/033085
§ 371 (c)(1),
(2) Date: Feb. 25, 2021

(87) PCT Pub. No.: WO2020/049695
PCT Pub. Date: Mar. 12, 2020

(65) Prior Publication Data

US 2021/0388505 A1 Dec. 16, 2021

(51) Int. Cl.
*C22C 9/04* (2006.01)
*A44B 19/24* (2006.01)
*C23C 22/52* (2006.01)

(52) U.S. Cl.
CPC ..... *C23C 22/52* (2013.01); *A44B 19/24* (2013.01); *C22C 9/04* (2013.01)

(58) Field of Classification Search
CPC ..... C22C 9/04
USPC ..... 428/469
See application file for complete search history.

(56) References Cited

U.S. PATENT DOCUMENTS 2,364,993 A 12/1944 Meyer
2,460,896 A * 2/1949 Meyer ..... C23C 22/63 252/187.23
2,460,898 A * 2/1949 Meyer ..... C23C 22/63 148/253

(Continued)

FOREIGN PATENT DOCUMENTS

CN 107400403 A * 11/2017 ..... A44B 19/24
CN 105803438 B 8/2018

(Continued)

OTHER PUBLICATIONS

Ma, CN 107400403A Google Patents Machine Translation printed on Aug. 8, 2023, Nov. 28, 2017, entire translation (Year: 2017).*

(Continued)

*Primary Examiner* — Katherine A Christy
(74) *Attorney, Agent, or Firm* — Kilpatrick Townsend & Stockton LLP

(57) ABSTRACT

A black metal fastener member can be manufactured at low cost. The fastener member comprises a base material made of a copper alloy containing zinc at a concentration of 30% by mass or more and 43% by mass or less, and a black copper oxide coating covering at least a part of the base material. The black copper oxide coating has a lower layer and an upper layer. The lower layer is a layer below a center line with respect to the thickness of the black copper oxide coating and the upper layer is a layer above the center line. The porosity of the lower layer is smaller than the porosity of the upper layer. In some cases, the difference between the porosity of the lower layer and the porosity of the upper layer is 10% or more.

20 Claims, 3 Drawing Sheets

Example 1

(56) References Cited

U.S. PATENT DOCUMENTS

| | | | | |
|---|---|---|---|---|
| 2003/0110601 | A1 | 1/2003 | Sugimoto et al. | |
| 2003/0102227 | A1 | 6/2003 | Billi et al. | |
| 2011/0036493 | A1 | 2/2011 | Kawamura et al. | |
| 2012/0297583 | A1* | 11/2012 | Sugimoto ..... | B21D 39/02 24/381 |
| 2013/0104349 | A1 | 5/2013 | Yoshimura et al. | |

FOREIGN PATENT DOCUMENTS

| | | | |
|---|---|---|---|
| EP | 2517593 | B1 | 11/2015 |
| JP | 61-500855 | A | 5/1986 |
| JP | H09-143753 | A | 6/1997 |
| JP | 10-158891 | A | 6/1998 |
| JP | H11-189881 | A | 7/1999 |
| JP | 2000-248375 | A | 9/2000 |
| JP | 2002-285264 | A | 10/2002 |
| JP | 2003-510466 | A | 3/2003 |
| JP | 2003-113454 | A | 4/2003 |
| JP | 2003-183750 | A | 7/2003 |
| JP | 2004-292898 | A | 10/2004 |
| JP | 2009-218368 | A | 9/2009 |
| JP | 2010-229555 | A | 10/2010 |
| JP | 3197413 | U | 5/2015 |
| JP | 3214550 | U | 1/2018 |
| WO | 2012/004841 | A1 | 1/2012 |
| WO | 2017/006402 | A1 | 1/2017 |

OTHER PUBLICATIONS

International Search Report, PCT Application No. PCT/JP2018/033085, mailed Nov. 6, 2018.

International Preliminary Report on Patentability, PCT Application No. PCT/JP2018/033085, mailed Mar. 18, 2021.

Supplementary European Search Report, European Patent Application No. 18932926.1, Mar. 2, 2022, 8 pages.

* cited by examiner

Example 1

FASTENER MEMBER

FIELD OF THE INVENTION

The present invention relates to a fastener member having a copper alloy as a base material. The present invention also relates to a fastener provided with a fastener member having a copper alloy as a base material.

BACKGROUND OF THE INVENTION

Among the fastener products, there are copper alloy fasteners (examples: Japanese Patent Application Publication No. 2003-183750, Japanese Patent Application Publication No. 2002-285264) in which a copper alloy containing zinc such as brass, red brass, and nickel silver (hereinafter, also referred to as "Cu—Zn-based alloy") is used for a component (for example, a row of elements that are engaging parts, a slider for controlling the engagement and separation of element rows to open and close the fastener, or the like). Zinc is an alloying element commonly added to copper alloy fasteners because it has the effect of increasing the strength, hardness, and uniform deformation amount of the alloy due to solid solution.

On the other hand, a technique for blackening the surface of copper and copper alloys is known. Japanese Patent Application Publication No. 2000-248375 discloses a chemical conversion treatment method for forming a black coating having a matte black appearance and a light-shielding property by growing a velvety copper oxide crystal coating. In the embodiments of the literature, it is described that a cylindrical brass component was subjected to alkaline degreasing, dezincification treatment, and black dyeing treatment (Ebonol treatment).

Japanese Patent Application Publication No. 2004-292898 discloses a method for producing a low-reflection material by anodizing a material formed from copper or a material having a copper-coated surface in an aqueous sodium hydroxide solution to form a divalent copper oxide coating.

Japanese Patent Application Publication No. H11-189881 proposes blackening composition, comprising:

(A) at least one selected from basic copper carbonate, copper hydroxide, copper (II) oxide or tetraammine copper (II) salt represented by Formula 1;

$[Cu(NH_3)_4X_2$ (in the formula, X is a monovalent anion consisting of OH, Cl, $NO_3$, NCS, Cu (I) $Cl_2$, ½ $SO_4$, $HCO_3$, ½ $CO_3$) Formula 1

(B) at least one selected from aqueous ammonia, ammonia gas, liquid ammonia, ammonium carbonate, and ammonium hydrogen carbonate;

(C) water as a residue;

characterized in that the concentrations of (copper component, ammonia component) in the composition are within the range surrounded by each point of (0.2% by weight, 2% by weight), (0.2% by weight, 10% by weight), (1.5% by weight, 20% by weight), (2.5% by weight, 20% by weight), (2.5% by weight, 10% by weight), and (1.5% by weight, 2% by weight).

In the embodiments of the invention of the literature, it is described that a component obtained by cutting a C3604 brass rod into a spherical shape having a diameter (φ) of 20 mm was blackened.

Japanese Patent Application Publication No. H09-143753 discloses a fin for a heat exchanger characterized in that it is formed by subjecting the surface of a copper plate to a chemical conversion to form a cupric oxide coating thereon by a blackening copper oxidation method. Specifically, it is disclosed that by boiling in an aqueous solution of 5% sodium hydroxide and 1% potassium persulfate at a temperature of 100° C. or higher for about 3 to 15 minutes, a cupric oxide coating having a thickness of 1 to 3 μm was formed on the surface of the copper plate.

Japanese Patent Application Publication No. 2003-510466 and Japanese Patent Application Publication No. 2010-229555 discloses a technique for forming an inorganic coating layer of crystalline copper (I) oxide (cuprous oxide, $Cu_2O$) on the surface of a copper or copper-based alloy member by an anodization method. In the working examples, it is described that red copper was anodized to obtain an appearance of dark brown, brown, or deep black tone.

Japanese Patent Application Publication No. 2009-218368 discloses an invention for the purpose of providing a surface treatment method (surface blackening treatment method) for printed wiring boards that is highly productive, allowing reduction of running costs, and is easy to handle and maintain. Specifically, there is disclosed a copper surface treatment method for forming a copper oxide coating containing cupric oxide as a main component on the surface of copper by electrolytic anodization in an alkaline aqueous solution containing copper oxide ions of 0.001 [mol/L] or more and no more than the saturation concentration.

CITATION LIST

Patent Literature

[Patent Literature 1] Japanese Patent Application Publication No. 2003-183750
[Patent Literature 2] Japanese Patent Application Publication No. 2002-285264
[Patent Literature 3] Japanese Patent Application Publication No. 2000-248375
[Patent Literature 4] Japanese Patent Application Publication No. 2004-292898
[Patent Literature 5] Japanese Patent Application Publication No. H11-189881
[Patent Literature 6] Japanese Patent Application Publication No. H09-143753
[Patent Literature 7] Japanese Patent Application Publication No. 2003-510466
[Patent Literature 8] Japanese Patent Application Publication No. 2010-229555
[Patent Literature 9] Japanese Patent Application Publication No. 2009-218368

SUMMARY OF THE INVENTION

In recent years, as users' preferences have diversified, metal fastener members having a wide variety of color tones have been demanded. On the other hand, the demand from users for cost reduction has been becoming stricter year by year, and it is desirable to be able to provide a metal fastener member having a desired color tone at low cost. Under such circumstances, in order to widen the color variation of the fastener member to the users, it would be advantageous to develop a technology capable of providing a black metal fastener member at low cost.

The present invention has been created in view of the above circumstances, and in one embodiment, one object of the present invention is to provide a black metal fastener member that can be manufactured at low cost. Further, in another embodiment, an object of the present invention is to provide a fastener comprising such a metal fastener member.

As far as the present inventors know, there is no precedents in the prior art in which a Cu—Zn-based alloy having a high zinc concentration of 30% by mass or more is used as a base material for a fastener member and the surface thereof is blackened. It is considered that one of the reasons is that in a Cu—Zn-based alloy, the cold workability decreases as the zinc concentration is increased.

However, zinc is excellent in economy because it is less expensive than copper. Therefore, it is advantageous to use a Cu—Zn-based alloy in which the amount of zinc added is significantly increased as the base material in order to reduce the cost. The present inventors have found that a black metal fastener member, which is less expensive than ever, can be obtained by preferentially promoting a high zinc concentration of the fastener member while accepting the above-mentioned disadvantages. The present invention has been completed based on the above technical idea, and is exemplified as below.

[1] A fastener member, comprising a base material made of a copper alloy containing zinc at a concentration of 30% by mass or more and 43% by mass or less, and a black copper oxide coating covering at least a part of the base material.

[2] The fastener member according to [1], wherein when the black copper oxide coating is divided into a lower layer below a center of thickness and an upper layer above the center of thickness, a porosity of the lower layer is smaller than that of the upper layer.

[3] The fastener member according to [2], wherein a difference between the porosity of the lower layer and that of the upper layer is 10% or more.

[4] The fastener member according to [2], wherein a difference between the porosity of the lower layer and that of the upper layer is 20% or more.

[5] The fastener member according to any one of [2] to [4], wherein the porosity of the upper layer is 14% or more.

[6] The fastener member according to [5], wherein the porosity of the upper layer is 20% or more.

[7] The fastener member according to any one of [2] to [6], wherein the porosity of the lower layer is 12% or less.

[8] The fastener member according to [7], wherein the porosity of the lower layer is 8% or less.

[9] The fastener member according to any one of [1] to [8], wherein a surface of the black copper oxide coating has color coordinates in a CIELAB color space defined by JIS Z8781-4 (2013) with a CIELAB color difference ($\Delta E^*ab$) of 7 or less from color coordinates (50, 1, −3).

[10] The fastener member according to any one of [1] to [9], wherein a thickness of the black copper oxide coating is 0.4 to 4.0 μm.

[11] A fastener comprising the fastener member according to any one of [1] to [10].

[12] An article comprising the fastener according to [11].

According to one embodiment of the present invention, it is possible to provide a black metal fastener member at low cost.

DETAILED DESCRIPTION OF THE INVENTION

Figure 1:
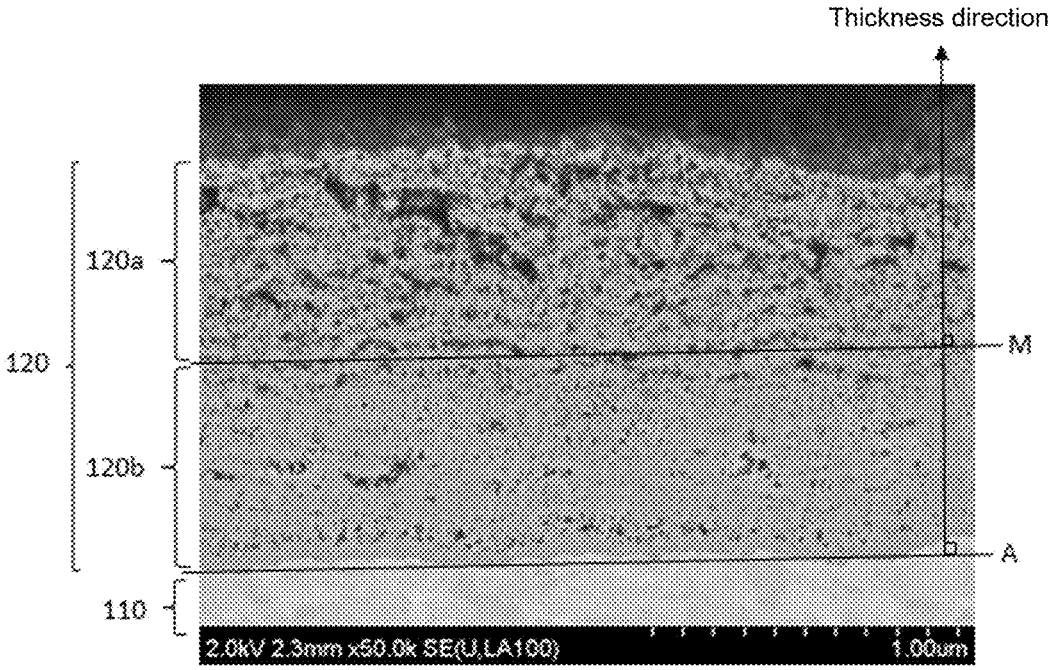
FIG. 1 is an example of a cross-sectional photograph of a black copper oxide coating including a boundary with a base material in a fastener member (element) according to Example 1

Hereinafter, embodiments of the present invention will be described in detail with reference to the figures. However, the present invention is not limited to these embodiments.

<1. Base Material Composition>

In one embodiment according to the present invention, the fastener member comprises a base material made of a copper alloy containing Zn at a concentration of 30% by mass or more and 43% by mass or less. In order to further enhance the effect of reducing the material cost, the zinc concentration in the copper alloy is preferably 32% by mass or more, and more preferably 34% by mass or more. In addition, from the viewpoint of molding processability, the zinc concentration in the copper alloy is preferably 43% by mass or less, and more preferably 41% by mass or less.

The copper alloy constituting the base material may contain a third element other than copper and zinc, for example, one or more of Sn, Al, Si, Fe, Ni, Mn, Mg and Pb. Among these it is preferable to contain Mn from the viewpoint of suppressing cracking over time. From the viewpoint of reducing the material cost, the total concentration of the third element(s) other than copper and zinc is preferably 10% by mass or less, more preferably 5% by mass or less, and even more preferably 1% by mass or less. From the viewpoint of suppressing cracking over time, it is preferable to contain one or more of Sn, Al, Si, Fe, Ni, Mn, Mg and Pb in a total amount of 0.1% by mass or more, more preferably 0.3% by mass or more. In particular, Mn is preferably contained in an amount of 0.1% by mass or more, and more preferably 0.3% by mass or more. Other than copper and zinc, the copper alloy constituting the base material may not contain other elements except for inevitable impurities.

Therefore, in one embodiment, the fastener member according to the present invention comprises a base made of a copper alloy containing Zn at a concentration of 30% by mass or more and 43% by mass or less, and the balance being Cu and inevitable impurities. Therefore, in one embodiment, the fastener member according to the present invention comprises a base made of a copper alloy containing Zn at a concentration of 30% by mass or more and 43% by mass or less, and one or more of Sn, Al, Si, Fe, Ni, Mn, Mg and Pb in a total of 0.1% by mass or more and 10% by mass or less, and the balance being Cu and inevitable impurities.

Inevitable impurities refer to impurities that are present in the raw material or are inevitably mixed in the manufacturing process, and are originally unnecessary, but they are allowed because they are in trace amounts and do not affect the characteristics. In the present invention, the content of each impurity element allowed as an inevitable impurity is normally 0.1% by mass or less, preferably 0.05% by mass or less.

<2. Black Copper Oxide Coating>

In one embodiment according to the present invention, the fastener member comprises a black copper oxide coating covering at least a part of the base material. The black copper oxide coating may cover 60% or more, or 80% or more, or 95% or more, or the entire of the surface area of the base material.

When blackening the surface of a Cu—Zn alloy having a high zinc concentration, it is desirable to pay attention to the porosity that did not need to be considered when blackening the surface of a Cu—Zn alloy having a low zinc concentration. Controlling the porosity is effective in achieving both the blackness of the black copper oxide coating and the adhesion of the black copper oxide coating to the base material. Specifically, when the black copper oxide coating is divided into a lower layer below a center of thickness and an upper layer above the center of thickness of the black copper oxide coating, it is preferable that a porosity of the lower layer be smaller than a porosity of the upper layer. In the upper layer, the higher the porosity is, the more the reflection is suppressed by the scattering of light and the blackness increases, while in the lower layer, the lower the porosity is, the stronger the adhesion to the base material becomes.

A method for measuring the porosity of the upper layer and the lower layer of the black copper oxide coating will be described. First, a cross section in the direction perpendicular to the surface of the black copper oxide coating is cut out from the fastener member as the object of measurement, and the cross-section of the black copper oxide coating including the boundary with the base material is observed with a scanning electron microscope (SEM) at a magnification of 50,000. FIG. 1 shows an example of a cross-sectional photograph of a black copper oxide coating 120 including a boundary with a base material 110 for the fastener member (element) according to Example 1 described later. An approximation straight line A with respect to the boundary line between the base material 110 and the black copper oxide coating 120 is drawn on the SEM photograph, and the direction orthogonal to the approximation straight line A is defined as the thickness direction of the black copper oxide coating 120. The approximation straight line A can be obtained by plotting the coordinates of a number of points forming the boundary line on an orthogonal coordinate system and using the least squares method.

Next, on the SEM photograph, the thickness of the black copper oxide coating 120 from the approximation straight line A is measured at 24 points along the approximation straight line A at intervals of 0.1 μm, and the average thickness of the black copper oxide coating 120 in the SEM photograph is calculated. Next, a straight line M parallel to the approximation straight line A and having a distance from the approximation straight line A equal to ½ of the average thickness is drawn on the SEM photograph, and this is set as the center of the thickness. The portion of the black copper oxide coating on the outer side (surface side) of the straight line M is defined as the upper layer 120*a* of the black copper oxide coating, and the portion of the black copper oxide coating on the inner side (base material side) of the straight line M is defined as the lower layer 120*b* of the black copper oxide coating.

Where it is preferable to make the porosity of the lower layer smaller than that of the upper layer, in order to achieve both the blackness of the black copper oxide coating and the adhesion of the black copper oxide coating to the base material, the difference between the porosity of the lower layer and that of the upper layer is more preferably 10% or more, more preferably 15% or more, and even more preferably 20% or more. The upper limit for the difference between the porosity of the lower layer and that of the upper layer is not particularly limited, but it is normally 30% or less, and typically 25% or less.

The porosity of the upper layer is preferably 14% or more, more preferably 18% or more, more preferably 20% or more, even more preferably 22%, and most preferably 25% or more, from the viewpoint of increasing the blackness of the black copper oxide coating. However, the porosity of the upper layer is preferably 40% or less, more preferably 35% or less, and even more preferably 30% or less, from the viewpoint of preventing color migration.

Further, the porosity of the lower layer is preferably 12% or less, more preferably 10% or less, even more preferably 8% or less, and most preferably 6% or less, from the viewpoint of improving the adhesion to the base material. The lower limit of the porosity of the lower layer is not particularly limited, but it is normally 2% or more, and typically 4% or more.

The porosity of the upper layer and the lower layer is determined by the following procedure, respectively. On the SEM photograph, the highest brightness portion is defined as the brightness 255, the lowest brightness portion is defined as the brightness 0, and binarization to black and white is made with the boundary at brightness 128. The number of black (void) and white (mainly oxide) pixels in the binarized image is measured in the upper and lower layers, respectively, and the ratio of the number of black pixels to the total number of pixels (total number of black and white pixels) is calculated for the upper layer and the lower layer, respectively, and thus defined as the porosity of the upper layer and the lower layer, respectively. The porosity is determined by using SEM photographs for 10 or more arbitrary fields of view, and the average value thereof is defined as the measured value.

In one embodiment of the fastener member according to the present invention, a surface of the black copper oxide coating may have color coordinates in a CIELAB color space defined by JIS Z8781-4 (2013) with a CIELAB color difference (ΔE*ab) of 7 or less, or 5 or less, or 3 or less from color coordinates (50, 1, −3).

The thickness of the black copper oxide coating is not particularly limited. However, from the viewpoint of deepening the blackness, it is preferably 0.4 μm or more, more preferably 0.7 μm or more, and even more preferably 1.0 μm or more. Further, the thickness of the black copper oxide coating is preferably 4.0 μm or less, more preferably 3.0 μm or less, and even more preferably 2.0 μm or less from the viewpoint of preventing color migration.

Regarding the thickness of the black copper oxide coating, in accordance with the method described above, the average thickness of the black copper oxide coating in each field of view is obtained by measuring 24 points at intervals of 0.1 μm along the approximation straight line A, and this procedure is performed for 10 or more arbitrary fields of view, and the average value of the 10 or more fields of view is defined as the measured value.

<3. Method for Manufacturing Fastener Member>

The metal fastener member can be formed, for example, by appropriately combining melt casting and cold working. An element for a slide fastener, which is a typical application of a metal fastener member, will be described as an example. First, the alloy components constituting the base material are mixed and melted, and then a wire is produced by continuous casting. After removing the unevenness of the surface of the obtained wire by a method such as peeling, the wire is drawn. Then, it is annealed to restore workability. After that, a continuous deformed wire having a substantially Y-shaped cross-section is produced while applying working strain by cold rolling. In this process, work hardening progresses according to the alloy composition, and the material strength increases. After that, various cold working such as cutting, pressing, bending, and caulking are performed to plant the fastener elements on a fastener tape. The blackening treatment of the fastener member may be performed after forming it into the final shape of the fastener member, or may be performed in the middle of cold working after melt casting.

The blackening treatment of the fastener member can be performed by a chemical conversion treatment for forming a black copper oxide coating on the surface of the base material of the fastener member. For example, the chemical conversion treatment can be carried out in the order of degreasing step→aqueous washing step→blackening step→aqueous washing step→drying step. In the blackening step, a blackening liquid containing an oxidizing agent and an alkaline agent can be used. Examples of the oxidizing agent include sodium hypochlorite, sodium chlorite, sodium chlorate, potassium hypochlorite, potassium chlorite, and potassium chlorate. One type of oxidizing agent may be used, or two or more types may be used in combination. Examples of the alkaline agent include sodium hydroxide and potassium hydroxide. One type of alkaline agent may be used, or two or more types may be used in combination. The blackening liquid is preferably heated in the range of 40 to 100° C. from the viewpoint of promoting the reaction. When blackening the surface of a Cu—Zn-based alloy having a high zinc concentration, it is important to adjust the concentration of the oxidizing agent and the alkaline agent in the blackening liquid. By adjusting the concentration of the oxidizing agent and the alkaline agent and controlling the oxidation rate and dezincification rate, it is possible to obtain a coating having a high porosity in the upper layer and a low porosity in the lower layer, and it is possible to form a black copper oxide coating having excellent adhesion.

Although it is not intended to limit the present invention to any theory, the role of the oxidizing agent and the alkaline agent is considered as follows. The oxidizing agent affects the rate of oxide formation, and the higher the concentration is, the faster the rate of oxidation becomes. In addition, the alkaline agent affects the rate of dezincification in the depth direction, and the higher the concentration is, the faster the rate of dezincification becomes. Therefore, if the alkaline agent concentration is high, the porosity of both the upper layer and the lower layer tends to be high, but if the oxidizing agent concentration is high at the same time, the oxidation reaction proceeds before sufficient dezincification occurs, so that the porosity of the lower layer is likely to be low. As a result, a black copper oxide coating having a low porosity in the lower layer and a high porosity in the upper layer can be obtained. The concentration of the oxidizing agent and the concentration of the alkaline agent depend on the types of the oxidizing agent and the alkaline agent, but for instance, the concentration of the oxidizing agent in the blackening liquid is preferably adjusted in the range of 0.001 to 1 mol/L. Further, the concentration of the alkaline agent in the blackening liquid is preferably adjusted in the range of 1.0 to 5.0 mol/L, and more preferably adjusted in the range of 2.0 to 4.0 mol/L.

One or more other surface treatments may be further applied to the black copper oxide coating. For example, a black paint such as black lacquer may be applied, or a surface treatment such as an anti-rust treatment may be applied.

<4. Fastener Member>

Examples of the fastener member according to the present invention include, but are not limited to, an element, a slider, a top stopper, and a bottom stopper for a slide fastener. The fastener member according to the present invention is not limited to slide fasteners, and can also be applied as a member for snap fasteners and other metal fasteners.

Figure 2:
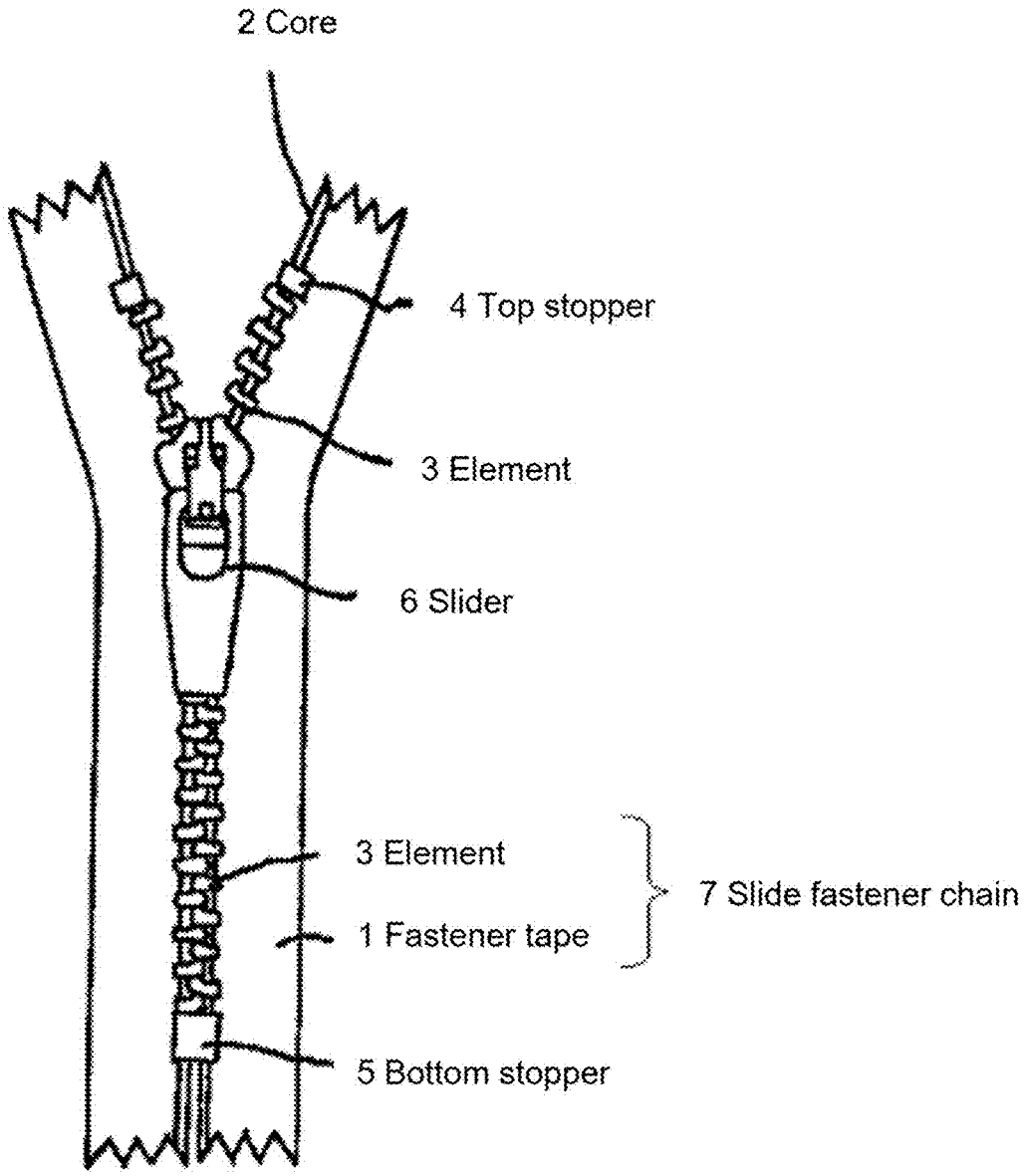
FIG. 2 is a schematic view of a slide fastener.

An example of a slide fastener provided with an element, a slider, a top stopper and a bottom stopper as the fastener member according to the present invention will be specifically described with reference to the figures. FIG. 2 is a schematic view of a slide fastener. As shown in FIG. 2, the slide fastener comprises a pair of fastener tapes 1 having a core 2 formed along one side edge, elements 3 caulked and fixed (attached) to the core 2 of the fastener tape 1 at predetermined intervals, a top stopper 4 and a bottom stopper 5 caulked and fixed to the core 2 of the fastener tape 1 at the top and bottom ends of the elements 3, and a slider 6 arranged between a pair of opposing elements 3 and slidable in the vertical direction for engaging and disengaging the elements 3. It is noted that a state in which the elements 3 are attached to the core 2 of one fastener tape 1 is referred to as a slide fastener stringer, and a state in which the elements 3 attached to the core 2 of a pair of fastener tapes 1 are engaged is referred to as a slide fastener chain 7.

Further, although not shown in the figure, the slider 6 shown in FIG. 2 is obtained by press working a lengthy body having a plate-shaped body and a rectangular cross-section in multiple stages, cutting at predetermined intervals to produce a slider body, and attaching a spring and a pull tab as necessary. Further, the pull tab is obtained by punching from a plate-shaped body having a rectangular cross-section into a predetermined shape, caulking and fixing to the slider body. In addition, the bottom stopper 5 may be a separable bottom end stop assembly composed of a first plug member, a second plug member, and a socket member so that the pair of slide fastener chains can be separated by a detaching operation of the slider.

Figure 3:
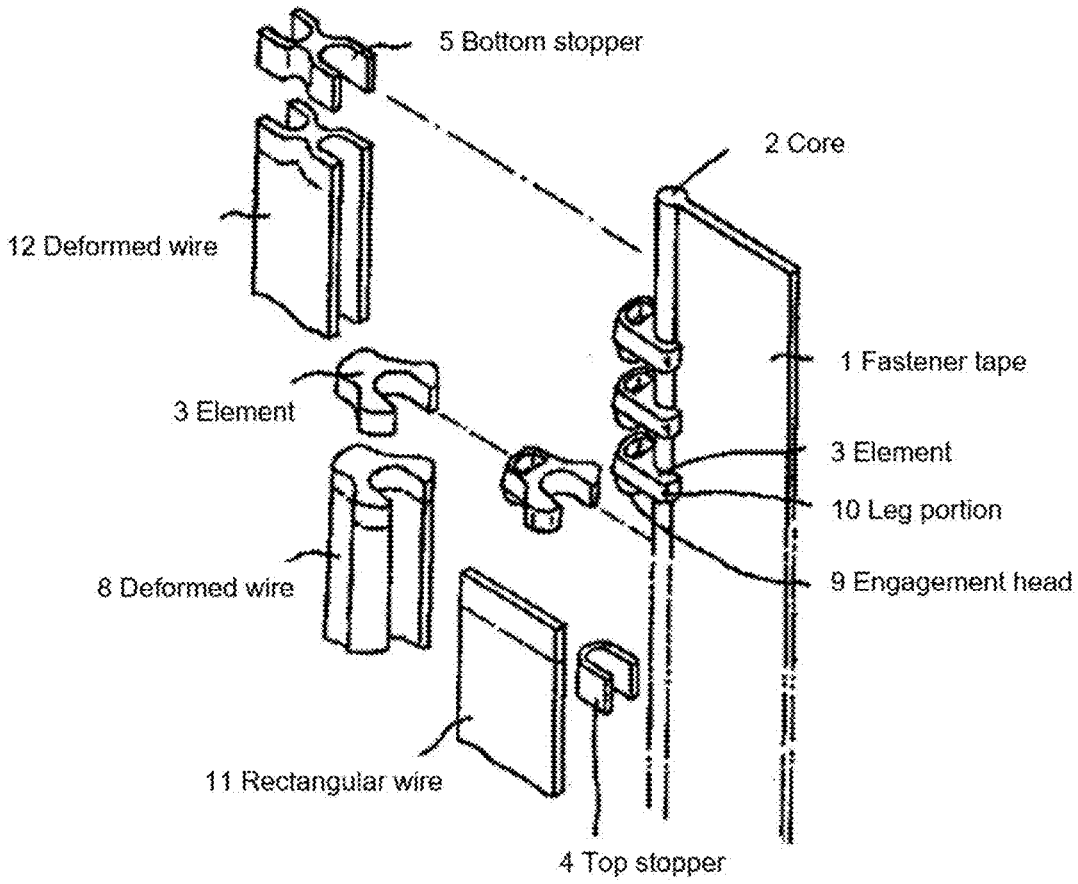
FIG. 3 is a diagram illustrating a method of attaching a bottom stopper, a top stopper, and elements to a fastener tape.

FIG. 3 is a drawing showing a method of manufacturing the elements 3, the top stopper 4 and the bottom stopper 5 of the slide fastener shown in FIG. 2 and a method of attaching them to the core 2 of the fastener tape 1. As shown in the figure, the elements 3 are attached to the core 2 of the fastener tape 1 by cutting a deformed wire 8 having a substantially Y-shaped cross-section at predetermined dimensions and then press-molding to form an engagement head 9, and then by caulking both leg portions 10.

The top stopper 4 is attached by cutting a rectangular wire 11 having a rectangular cross-section (flat wire) at predetermined dimensions, forming into a substantially U-shaped cross-section by bending, and then by caulking to the core 2 of the fastener tape 1. The bottom stopper 5 is attached by cutting a deformed wire 12 having a substantially X-shaped cross-section at predetermined dimensions, and then caulking to the core 2 of the fastener tape 1.

In the figure, the elements 3, the top and bottom stoppers 4 and 5 are shown to be attached to the fastener tape 1 at the same time, but in reality, the elements 3 are continuously attached to the fastener tape 1 to firstly prepare the fastener chain, and the predetermined top and bottom stoppers 4 or 5 are attached in close proximity to the elements 3 at both ends of the fastener chain.

The slide fastener can be attached to various articles and particularly functions as an opening/closing tool. The article to which the slide fastener is attached is not particularly limited, and examples thereof include daily necessities such as clothing, bags, shoes and miscellaneous goods, as well as industrial items such as water storage tanks, fishing nets and space suits.

EXAMPLES

Examples of the present invention will be described below, but these are provided for a better understanding of the present invention and its advantages, and are not intended to limit the present invention.

<1. Preparation of Fastener Chain>

Cu (purity 99.99% by mass or more) and Zn (purity 99.9% by mass or more) were used as raw materials. These raw materials were mixed so as to have each alloy composition according to the test number shown in Table 1-1 and melted in a continuous casting apparatus, and then a continuous wire was produced by continuous casting. The obtained continuous wire was drawn. Next, annealing was performed at 500° C. for 1 hour in a reducing atmosphere containing about 10 mass ppm of oxygen to restore cold workability, and then cold rolling was performed to produce a continuous deformed wire having a substantially Y-shaped cross-section. After that, various cold working such as cutting, pressing, bending, and caulking were performed to obtain an element shape of "5R" size specified in the YKK Corporation catalog "FASTENING Senka (issued in February 2009)". Next, these were attached to a polyester fastener tape to prepare a slide fastener stringer, and further, the opposing elements of a pair of slide fastener stringers were engaged with each other to produce a slide fastener chain.

<2. Blackening Treatment>

The slide fastener chain produced above was subjected to a blackening step after alkaline degreasing and washing with water. The blackening step was carried out by immersing the slide fastener chain in a blackening liquid at 80° C. containing an oxidizing agent and an alkaline agent for 5 minutes while the slide fastener chain was transported roll-to-roll. In the blackening step, by changing the concentrations (mol/L) of the oxidizing agent and the alkaline agent in the blackening liquid according to the test numbers shown in Table 1-1, the porosity of the upper layer and the lower layer of the copper oxide coating was changed. Then, the slide fastener chain was washed with water and dried while being transported roll-to-roll.

<3. Visual Color Observation>

After the blackening treatment, the color of the copper oxide coating formed on the element surface of the slide fastener chain of each test example was visually observed. The results are shown in Table 1-2.

<4. Color Coordinate Measurement of Copper Oxide Coating>

After the blackening treatment, an arbitrary element was removed from the slide fastener chain of each test example. By the method described above, the color coordinates in the CIELAB color space defined by JIS Z8781-4 (2013) of the surface of the copper oxide coating of the element were measured. As the color difference meter, CR-300 available from Minolta Co., Ltd. was used. The measurement conditions were 0 to 40° C. and 85% RH or less. A pulse xenon lamp was used as the light source. The measurement results are shown in Table 1-2 as the CIELAB color difference (ΔE*ab) with respect to the color coordinates (50, 1, −3) as the reference for black. In addition, a* and b* represent color tones, where a* represents magenta-green tone ("+" is closer to magenta, and "−" is closer to green), and b* represents yellow-blue tone ("+" is closer to yellow, and "−" is closer to blue). L* represents lightness, and the larger the value is, the higher the glossiness is.

<5. Thickness and Porosity of Copper Oxide Coating>

For the element of each test example whose color coordinates were measured, the thickness and porosity of the copper oxide coating were measured by the method described above. The cutting of the element for exposing the cross-section of the copper oxide coating was carried out by embedding it in a resin, mechanically polishing the element, and performing an ion milling process (CP process). The cross-sectional observation of the copper oxide coating was carried out using a scanning electron microscope (SEM) (model S-4800 available from Hitachi High-Technologies Corporation) at a pressurizing voltage of 2 kV, a probe current of 15 μA, and a working distance (WD) of about 2 mm. The binarization process for measuring the porosity was performed by JTrim, a free software. The results are shown in Table 1-2.

<6. Adhesion of Copper Oxide Coating>

The adhesion of the copper oxide coating was evaluated according to the following criteria by visually observing 10 arbitrary continuous elements of the fastener chain from one side after the blackening treatment over a total area of 25 $mm^2$.

A: No peeled locations of the copper oxide coating was confirmed.

B: 1 to 10 peeled locations of the copper oxide coating were confirmed.

C: More than 10 peeled locations of the copper oxide coating were observed.

TABLE 1-1

| Test number | Alloy composition | Oxidizing agent concentration (mol/L) | Alkaline agent concentration (mol/L) |
|---|---|---|---|
| Example 1 | Zn: 39.2 masss %, Cu: 59.9 masss %, Mn 0.9 mass % | 0.78 | 3.5 |
| Example 2 | Zn: 39.2 masss %, Cu: 59.9 masss %, Mn 0.9 mass % | 0.24 | 3.5 |
| Example 3 | Zn: 35 masss %, Cu: 65 masss % | 0.45 | 2.5 |
| Example 4 | Zn: 35 masss %, Cu: 65 masss % | 0.25 | 2.5 |
| Comparative Example 1 | Zn: 39.2 masss %, Cu: 59.9 masss %, Mn 0.9 mass % | 0.96 | 3.76 |
| Comparative Example 2 | Zn: 15 masss %, Cu: 85 masss % | 0.32 | 1.88 |
| Comparative Example 3 | Zn: 15 masss %, Cu: 85 masss % | 0.45 | 2.5 |

TABLE 1-2

| | Copper oxide coating | | | | Color evaluation | | |
|---|---|---|---|---|---|---|---|
| Test number | Upper layer porosity (%) | Lower layer porosity (%) | Difference of porosity (%) | Thickness (μm) | Visual color | CIELAB color difference (ΔE * ab) | Adhesion |
| Example 1 | 26.3 | 5.7 | 20.6 | 1.23 | Black | 7 or less | A |
| Example 2 | 18.7 | 20.7 | −2 | 1.09 | Black | 7 or less | B |
| Example 3 | 27.2 | 4.9 | 22.3 | 1.05 | Black | 7 or less | A |

TABLE 1-2-continued

| | Copper oxide coating | | | | Color evaluation | | |
|---|---|---|---|---|---|---|---|
| Test number | Upper layer porosity (%) | Lower layer porosity (%) | Difference of porosity (%) | Thickness (μm) | Visual color | CIELAB color difference (ΔE * ab) | Adhesion |
| Example 4 | 15.4 | 34.7 | −19.3 | 1.1 | Black | 7 or less | C |
| Comparative Example 1 | 13.0 | 0.6 | 12.4 | 0.3 | Red | 8 or more | A |
| Comparative Example 2 | 13.2 | 7.8 | 5.4 | 1.05 | Black | 7 or less | A |
| Comparative Example 3 | 9.6 | 10.4 | −0.8 | 1.22 | Black | 7 or less | A |

<Discussion>

Example 1, Example 2 and Comparative Example 1 having similar alloy compositions are compared. In Comparative Example 1, the concentration of the alkaline agent was high, but the concentration of the oxidizing agent was too high, so that the porosity of both the upper layer and the lower layer was low. Therefore, although the adhesion was good, the blackening was insufficient. On the other hand, in Example 1, the alkaline agent concentration was slightly lower and the oxidizing agent concentration was slightly lower, so that the low porosity of the lower layer and the high porosity of the upper layer were achieved at the same time. As a result, a black copper oxide coating having excellent adhesion was obtained. In Example 2 in which the oxidizing agent concentration was further lowered, the porosity of the lower layer was higher than the porosity of the upper layer, so that blackening was achieved, but the adhesion was lowered.

Example 3 and Example 4 having similar alloy compositions are compared. In Example 3, the porosity of the lower layer was low and the porosity of the upper layer was high because the concentrations of the alkaline agent and the oxidizing agent were properly balanced. As a result, a black copper oxide coating having excellent adhesion was obtained. On the other hand, in Example 4, since the concentration of the oxidizing agent was low, the porosity of the lower layer was increased, so that blackening was achieved, but the adhesion was lowered.

Comparative Example 2 and Comparative Example 3 having similar alloy compositions are compared. Both used copper-zinc alloys with a low zinc concentration of 15% by mass. Therefore, the structure of the formed copper oxide was different from that of Examples 1, 2, 3, 4 and Comparative Example 1, and even if the porosity of the upper layer and the porosity of the lower layer changed, the degree of blackness was not affected and there was almost no change in adhesion.

DESCRIPTION OF REFERENCE NUMERALS

1 Fastener tape
2 Core
3 Element
4 Top stopper
5 Bottom stopper
6 Slider
7 Slide fastener chain
8 Deformed wire with a substantially Y-shaped cross-section
9 Engagement head
10 Leg portion
11 Rectangular wire
12 Deformed wire with an approximately X-shaped cross-section
110 Base material
120 Black copper oxide coating

The invention claimed is:

1. A fastener member, comprising a base material having a shape of an element of a slide fastener, a slider of a slide fastener, a top stopper of a slide fastener, or a bottom stopper of a slide fastener, and made of a copper alloy containing zinc at a concentration of 30% by mass or more and 43% by mass or less, and a black copper oxide coating covering at least a part of the base material, wherein a porosity of a lower layer is smaller than a porosity of an upper layer, in which the lower layer is a layer below a center line with respect to a thickness of the black copper oxide coating, and the upper layer is a layer above the center line with respect to the thickness of the black copper oxide coating, and wherein a difference between the porosity of the lower layer and the porosity of the upper layer is 10% or more.

2. The fastener member according to claim 1, wherein a difference between the porosity of the lower layer and that the porosity of the upper layer is 20% or more.

3. The fastener member according to claim 1, wherein the porosity of the upper layer is 14% or more.

4. The fastener member according to claim 3, wherein the porosity of the upper layer is 20% or more.

5. The fastener member according to claim 1, wherein the porosity of the lower layer is 12% or less.

6. The fastener member according to claim 5, wherein the porosity of the lower layer is 8% or less.

7. The fastener member according to claim 1, wherein a surface of the black copper oxide coating has color coordinates in a CIELAB color space defined by JIS Z8781-4 (2013) with a CIELAB color difference (ΔE*ab) of 7 or less from color coordinates (50, 1, −3).

8. The fastener member according to claim 1, wherein a thickness of the black copper oxide coating is 0.4 to 4.0 μm.

9. A fastener comprising the fastener member according to claim 1.

10. An article comprising the fastener according to claim 9.

11. A snap fastener member, comprising a base material having a shape of the snap fastener member, and made of a copper alloy containing zinc at a concentration of 30% by mass or more and 43% by mass or less, and a black copper oxide coating covering at least a part of the base material, wherein a porosity of a lower layer is smaller than a porosity of an upper layer, in which the lower layer is a layer below a center line with respect to a thickness of the black copper oxide coating, and the upper layer is a layer above the center line with respect to the thickness of the black copper oxide coating, and wherein a difference between the porosity of the lower layer and the porosity of the upper layer is 10% or more.

12. The snap fastener member according to claim 11, wherein a difference between the porosity of the lower layer and that the porosity of the upper layer is 20% or more.

13. The snap fastener member according to claim 11, wherein the porosity of the upper layer is 14% or more.

14. The snap fastener member according to claim 11, wherein the porosity of the upper layer is 20% or more.

15. The snap fastener member according to claim 11, wherein the porosity of the lower layer is 12% or less.

16. The snap fastener member according to claim 11, wherein the porosity of the lower layer is 8% or less.

17. The snap fastener member according to claim 11, wherein a surface of the black copper oxide coating has color coordinates in a CIELAB color space defined by JIS Z8781-4 (2013) with a CIELAB color difference ($\Delta E^*ab$) of 7 or less from color coordinates (50, 1, −3).

18. The snap fastener member according to claim 11, wherein a thickness of the black copper oxide coating is 0.4 to 4.0 μm.

19. A snap fastener comprising the snap fastener member according to claim 11.

20. An article comprising the snap fastener according to claim 19.

* * * * *